US007311853B2

(12) United States Patent
Vinson et al.

(10) Patent No.: US 7,311,853 B2
(45) Date of Patent: Dec. 25, 2007

(54) PAPER SOFTENING COMPOSITIONS CONTAINING QUATERNARY AMMONIUM COMPOUND AND HIGH LEVELS OF FREE AMINE AND SOFT TISSUE PAPER PRODUCTS COMPRISING SAID COMPOSITIONS

(75) Inventors: Kenneth Douglas Vinson, Cincinnati, OH (US); Yen Chun Wu, Holly Springs, NC (US); Arnold William Trueman, Hamilton, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 446 days.

(21) Appl. No.: 10/251,295

(22) Filed: Sep. 20, 2002

(65) Prior Publication Data

US 2004/0057982 A1 Mar. 25, 2004

(51) Int. Cl.
*D06M 15/00* (2006.01)

(52) U.S. Cl. ..... 252/8.81; 252/8.86

(58) Field of Classification Search ..... 252/8.8; 162/158

See application file for complete search history.

(56) References Cited

U.S. PATENT DOCUMENTS

| | | | | |
|---|---|---|---|---|
| 3,301,746 | A | 1/1967 | Sanford et al. | |
| 3,473,576 | A | 10/1969 | Amneus | |
| 3,573,164 | A | 3/1971 | Friedberg et al. | |
| 3,700,623 | A | 10/1972 | Kleim | |
| 3,772,076 | A | 11/1973 | Kleim | |
| 3,812,000 | A | 5/1974 | Salvucci, Jr. et al. | |
| 3,821,068 | A | 6/1974 | Shaw | |
| 3,974,025 | A | 8/1976 | Ayers | |
| 4,011,389 | A | 3/1977 | Langdon et al. | |
| 4,144,122 | A | 3/1979 | Emanuelsson et al. | |
| 4,191,609 | A | 3/1980 | Trokhan | |
| 4,208,459 | A | 6/1980 | Becker et al. | |
| 4,239,065 | A | 12/1980 | Trokhan | |
| 4,300,981 | A | 11/1981 | Carstens | |
| 4,528,239 | A | 7/1985 | Trokhan | |
| 4,637,859 | A | 1/1987 | Trokhan | |
| 4,846,990 | A * | 7/1989 | Upadek et al. | 510/308 |

(Continued)

FOREIGN PATENT DOCUMENTS

EP 0617164 A1 9/1994

(Continued)

OTHER PUBLICATIONS

Hermans, et al. in U.S. Statutory Invention Registration H1672 published Aug. 5, 1997.

*Primary Examiner*—Neil S. Levy
(74) *Attorney, Agent, or Firm*—Peter T. Nguyen; Betty J. Zea; Stephen T. Murphy

(57) ABSTRACT

A composition for softening an absorbent tissue having from about 10% to about 60% by weight of a quaternary ammonium softening active ingredient; free amine compounds at a level such that the softening composition has a tertiary to quaternary amine ratio of greater than about 0.06 and less than about 0.2; an aqueous vehicle in which said softening active ingredient is dispersed; and from about 0.01% to about 5% by weight of a high polymer; wherein the high polymer has a weight-average molecular weight of from about 2,000,000 to about 25,000,000.

8 Claims, 1 Drawing Sheet

U.S. PATENT DOCUMENTS

| | | | | |
|---|---|---|---|---|
| 4,874,465 | A | | 10/1989 | Cochrane et al. |
| 4,981,557 | A | | 1/1991 | Bjorkquist |
| 5,059,282 | A | | 10/1991 | Ampulski et al. |
| 5,215,626 | A | | 6/1993 | Ampulski et al. |
| 5,221,435 | A | | 6/1993 | Smith |
| 5,228,954 | A | | 7/1993 | Vinson et al. |
| 5,246,545 | A | | 9/1993 | Ampulski et al. |
| 5,264,082 | A | | 11/1993 | Phan et al. |
| 5,405,499 | A | | 4/1995 | Vinson |
| 5,415,737 | A | | 5/1995 | Phan et al. |
| 5,487,813 | A | | 1/1996 | Vinson et al. |
| 5,510,000 | A | | 4/1996 | Phan et al. |
| 5,525,345 | A | | 6/1996 | Warner et al. |
| 5,538,595 | A | | 7/1996 | Trokhan et al. |
| 5,543,067 | A | | 8/1996 | Phan et al. |
| 5,573,637 | A | | 11/1996 | Ampulski et al. |
| 5,611,890 | A | | 3/1997 | Vinson et al. |
| 5,637,743 | A | | 6/1997 | Contet et al. |
| 5,656,132 | A | | 8/1997 | Farrington et al. |
| 5,750,492 | A | | 5/1998 | Contet et al. |
| 5,753,079 | A | | 5/1998 | Jenny et al. |
| 5,814,188 | A | | 9/1998 | Vinson et al. |
| 6,162,329 | A | * | 12/2000 | Vinson et al. ..... 162/158 |
| 6,228,223 | B1 | | 5/2001 | Thebrin et al. |
| 6,420,013 | B1 | | 7/2002 | Vinson et al. |
| 6,547,928 | B2 | * | 4/2003 | Barnholtz et al. ..... 162/127 |
| 2002/0112831 | A1 | | 8/2002 | Barnholtz et al. |

FOREIGN PATENT DOCUMENTS

| | | |
|---|---|---|
| EP | 0677612 A2 | 10/1995 |
| EP | 0688901 A2 | 12/1995 |
| WO | WO 00/22231 | 4/2000 |
| WO | WO 00/22233 | 4/2000 |
| WO | WO 00/68502 | 11/2000 |

* cited by examiner

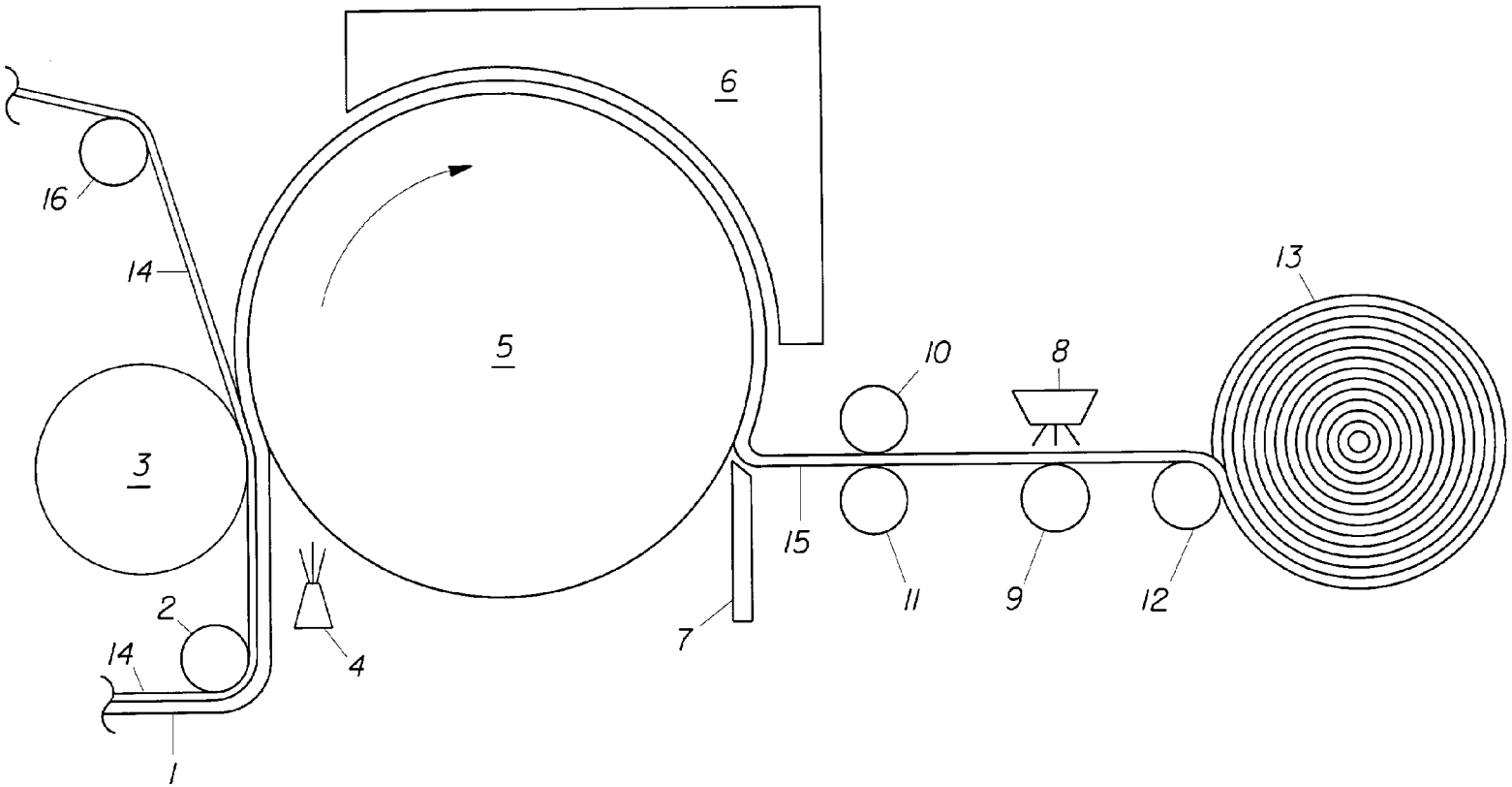
13
12
8
9
10
11
15
6
7
5
4
2
1
14
3
14
16

PAPER SOFTENING COMPOSITIONS CONTAINING QUATERNARY AMMONIUM COMPOUND AND HIGH LEVELS OF FREE AMINE AND SOFT TISSUE PAPER PRODUCTS COMPRISING SAID COMPOSITIONS

TECHNICAL FIELD

This invention relates, in general, to paper softening compositions which may be applied to tissue paper for enhancing the softness thereof. The invention also relates to soft, tissue paper products containing these compositions.

BACKGROUND OF THE INVENTION

Making soft tissue and toweling products which promote comfortable cleaning without performance impairing sacrifices has long been the goal of the engineers and scientists who are devoted to research into improving tissue paper. There have been numerous attempts to reduce the abrasive effect, i.e., improve the softness of tissue products. One area which has received a considerable amount of attention is the addition of chemical softening agents (also referred to herein as "chemical softeners") to tissue and toweling products.

The field of work in the prior art pertaining to chemical softeners has taken two paths. The first path is characterized by the addition of softeners to the tissue paper web during its formation either by adding an attractive ingredient to the vats of pulp which will ultimately be formed into a tissue paper web, to the pulp slurry as it approaches a paper making machine, or to the wet web as it resides on a Fourdrinier cloth or dryer cloth on a paper making machine. See U.S. Pat. No. 5,264,082, issued to Phan and Trokhan on Nov. 23, 1993, and U.S. Pat. No. 5,059,282, issued to Ampulski, et. al. on Oct. 22, 1991.

The second path is categorized by the addition of chemical softeners to tissue paper web after the web is dried or overdried. Applicable processes can be incorporated into the paper making operation as, for example, by spraying onto the dry web before it is wound into a roll of paper. Exemplary art from this field includes U.S. Pat. No. 5,215,626, issued to Ampulski, et. al. on Jun. 1, 1993; U.S. Pat. No. 5,246,545, issued to Ampulski, et. al. on Sep. 21, 1993; U.S. Pat. No. 5,525,345, issued to Warner, et. al. on Jun. 11, 1996, U.S. Pat. No. 6,162,329, issued to Vinson on Dec. 19, 2000, U.S. Pat. No. 6,179,691, issued to Ficke et al. on Jan. 30, 2001; U.S. Pat. No. 6,261,580, issued to Trokhan et al. on Jul. 17, 2001; U.S. Pat. No. 6,420,013, issued to Vinson et al. on Jul. 16, 2002, PCT Applications WO 00/22231 and 00/22233, filed in the name of Vinson et al., published on Apr. 20, 2000; and PCT Application WO 02/48458, filed in the name of Vinson et al., published on Jun. 20, 2002.

Those skilled in the art will recognize that both technology paths, more particularly the second path, are advanced by inventions of chemical softening mixtures having liposomal microstructures present at high concentration in a vehicle. The most recent of the development work in this area has focused on the improvement of the rheological properties of the chemical softening compositions. U.S. Pat. No. 6,162,329 teaches the use of high concentration compositions of softening agents which maintain a viscosity at a level where they can be easily applied to the web. Specifically, U.S. Pat. No. 6,162,329 teaches the addition of electrolytes to the composition. WO 00/22231 and 22233 further improve the rheology of the high concentration compositions by utilizing a bilayer disrupter to create a micellular structure which allows for more efficient application of the chemical softener to the paper web.

Unfortunately, the existing technology, while improving the rheology of liposomal softening compositions; does not, for example, reduce the viscosity of all quaternary esters to a level where they can effectively be used in the application processes of the paper making operation. For example, high concentration compositions of quaternized soft tallow-di-esterfied with methyldiethanolamine—form low viscosity compositions, however, high concentration compositions of quaternized soft tallow-di-esterified with triethanolamine is still a thick composition, which, for example, renders it incapable of being applied to paper webs at concentrations necessary to deliver high quality softening benefits.

Accordingly, it is desirable to find a way to further improve the rheology of liposomal softening compositions comprising quaternary amine compounds, to be able to use a wider variety of them in paper products. Such improved products, compositions, and processes are provided by the present invention as is shown in the following disclosure.

SUMMARY OF THE INVENTION

The present invention relates to a composition for softening an absorbent tissue comprising:

a) a quaternary ammonium softening active ingredient;
b) free amine compounds at a level such that the softening composition has a tertiary to quaternary amine ratio greater than about 0.06 and less than about 0.2; and
c) a vehicle in which said softening active ingredient is dispersed.

BRIEF DESCRIPTION OF THE FIGURE

While the specification concludes with claims particularly pointing out and distinctly claiming the present invention, it is believed that the present invention will be better understood from the following description in conjunction with the appended example and with the following drawing, in which like reference numbers identify identical elements and wherein:

The FIGURE is a schematic representation illustrating a preferred embodiment of the process of the present invention of adding a softening composition compounds to a tissue web.

The present invention is described in more detail below.

DETAILED DESCRIPTION OF THE INVENTION

Briefly, the present invention provides a composition which may be applied to a tissue web, most preferably applied to the surface of a dry tissue web, an overdried tissue web, or to a semi-dry tissue web. The resulting tissue paper has enhanced tactilely perceivable softness.

The term "vehicle" as used herein means a fluid that completely dissolves a chemical papermaking additive, or a fluid that is used to emulsify a chemical papermaking additive, or a fluid that is used to suspend a chemical papermaking additive. The vehicle may also serve as a carrier that contains a chemical additive or aids in the delivery of a chemical papermaking additive. All references are meant to be interchangeable and not limiting. The dispersion is the fluid containing the chemical papermaking additive. The term "dispersion" as used herein includes true solutions, suspensions, and emulsions. For purposes for this invention, all terms are interchangeable and not limiting. If the vehicle is water or an aqueous solution, then, preferably, the hot web is dried to a moisture level below its equilibrium moisture content (at standard conditions) before being contacted with the composition. However, this process is also applicable to tissue paper at or near its equilibrium moisture content as well.

As used herein, the term "hot tissue web" refers to a tissue web which is at an elevated temperature relative to room temperature. Preferably the elevated temperature of the web is at least about 43° C., and more preferably at least about 65° C.

The term "dry tissue web" as used herein includes both webs which are dried to a moisture content less than the equilibrium moisture content thereof (overdried-see below) and webs which are at a moisture content in equilibrium with atmospheric moisture. A semi-dry tissue paper web includes a tissue web with a moisture content exceeding its equilibrium moisture content. Most preferably the composition herein is applied to a dry tissue paper web.

The moisture content of a tissue web is related to the temperature of the web and the relative humidity of the environment in which the web is placed. As used herein, the term "overdried tissue web" refers to a tissue web that is dried to a moisture content less than its equilibrium moisture content at standard test conditions of 23° C. and 50% relative humidity. The equilibrium moisture content of a tissue web placed in standard testing conditions of 23° C. and 50% relative humidity is approximately 7%. A tissue web of the present invention can be overdried by raising it to an elevated temperature through use of drying means known to the art such as a Yankee dryer or through air drying. Preferably, an overdried tissue web will have a moisture content of less than 7%, more preferably from about 0 to about 6%, and most preferably, a moisture content of from about 0 to about 3%, by weight.

Paper exposed to the normal environment typically has an equilibrium moisture content in the range of 5 to 8%. When paper is dried and creped the moisture content in the sheet is generally less than 3%. After manufacturing, the paper absorbs water from the atmosphere. In the preferred process of the present invention, advantage is taken of the low moisture content in the paper as it leaves the doctor blade as it is removed from the Yankee dryer (or the low moisture content of similar webs as such webs are removed from alternate drying means if the process does not involve a Yankee dryer).

All documents cited are, in relevant part, incorporated herein by reference; the citation of any document is not to be construed as an admission that it is prior art with respect to the present invention.

All percentages, ratios and proportions herein are by weight, unless otherwise specified.

Softening Composition

It is known that very low levels of softener additives, e.g. cationic softeners, provide a significant tissue softening effect when applied to the surface of tissue webs in accordance with the present invention. Since the softening composition has a high concentration of softening active when the softening composition is applied, a relatively low amount of the vehicle is applied to the web. Therefore, the composition can be applied to dry tissue webs without disrupting the dry fiber structure of the paper web and no further drying of the tissue web is required. Further, since the softening composition of the present invention contains a minimal level of nonfunctional ingredients, the composition has a minimal effect on the strength of a tissue web after it has been applied.

Surprisingly, it has been found that softening compositions comprising a quaternary amine combined with an optimum level of tertiary (or, so-called, "free") amine in the vehicle form more stable and lower viscosity dispersions of multi-lamellar vesicles than the similar composition having the quaternary amine combined with either lower levels or higher levels of tertiary amines. Without being limited by theory, it is believed that the relative head group/tail group size of the tertiary amine versus quaternary amines make the two unusually compliant in the subject dispersions. Specifically, it is believed that the tertiary amine co-resides in the palisade layers making up the multi-lamellar vesicle wall alternating the turning radius and therefore the particle size of the resultant emulsion.

In general, the softening composition of the present invention comprises a softening active ingredient, comprising a free or tertiary amine at a level such that the softening composition has a tertiary to quaternary amine ratio greater than about 0.06 and less than about 0.2 in a vehicle. When applied to tissue paper as described herein, such compositions are effective in softening the tissue paper. The following discusses each of the components of the softening composition of the present invention, the properties of the composition, methods of producing the composition, and methods of applying the composition.

Softening Active Ingredients

As used herein, the term "softening active ingredient" refers to any chemical ingredient which improves the tactile sensation perceived by the consumer who holds a particular paper product and rubs it across the skin. Although somewhat desirable for towel products, softness is a particularly important property for facial and toilet tissues. Such tactilely perceivable softness can be characterized by, but is not limited to, friction, flexibility, and smoothness, as well as subjective descriptors, such as a feeling like lubricious, velvet, silk or flannel. Suitable materials include those which impart a lubricious feel to tissue. This includes, for exemplary purposes only, basic waxes such as paraffin and beeswax and oils such as mineral oil and silicone oil as well as petrolatum and more complex lubricants and emollients such as quaternary ammonium compounds with long alkyl chains, functional silicones, fatty acids, fatty alcohols and fatty esters. Preferred softening actives are quaternary ammonium compounds; mono-, di-, or triester quaternary ammonium compounds; di-quaternary esterified ammonium compounds, or mixtures thereof.

Quaternary compounds have the formula:

$$(R_1)_{4-m}—N^+—[R_2]_mX^-$$

where m is 1 to 3; each $R_1$ is a $C_1$-$C_6$ alkyl group, hydroxyalkyl group, hydrocarbyl or substituted hydrocarbyl group, alkoxylated group, benzyl group, or mixtures thereof; each $R_2$ is a $C_{14}$-$C_{22}$ alkyl group, hydroxyalkyl group, hydrocarbyl or substituted hydrocarbyl group, alkoxylated group, benzyl group, or mixtures thereof; and $X^-$ is any softener-compatible anion suitable for use in the present invention. Preferably, each $R_1$ is methyl and $X^-$ is chloride or methyl sulfate. Preferably, each $R_2$ is $C_{16}$-$C_{18}$ alkyl or alkenyl, most preferably each $R_2$ is straight-chain $C_{18}$ alkyl or alkenyl. Optionally, the $R_2$ substituent can be derived from vegetable oil sources. Several types of the vegetable oils (e.g., olive, canola, safflower, sunflower, etc.) can used as sources of fatty acids to synthesize the quaternary ammonium compound. Branched chain actives (e.g., made from isostearic acid) are also effective.

Such structures include the well-known dialkyldimethylammonium salts (e.g., ditallowdimethylammonium chloride, ditallowdimethylammonium methyl sulfate, di(hydrogenated tallow)dimethyl ammonium chloride, etc.) and trialkylmethylammonium salts (e.g., tritallowmethylammonium chloride, tritallowmethylammonium methyl sulfate, tri(hydrogenated tallow)methyl ammonium chloride, etc.), in which $R_1$ are methyl groups, $R_2$ are tallow groups of varying levels of saturation, and $X^-$ is chloride or methyl sulfate.

As discussed in Swern, Ed. in Bailey's Industrial Oil and Fat Products, Third Edition, John Wiley and Sons (New York 1964), tallow is a naturally occurring material having a variable composition. Table 6.13 in the above-identified reference edited by Swern indicates that typically 78% or more of the fatty acids of tallow contain 16 or 18 carbon atoms. Typically, half of the fatty acids present in tallow are unsaturated, primarily in the form of oleic acid. Synthetic as well as natural "tallows" fall within the scope of the present invention. It is also known that depending upon the product characteristic requirements, the saturation level of the ditallow can be tailored from non hydrogenated (soft) to touch (partially hydrogenated) or completely hydrogenated (hard). All of above-described saturation levels of are expressly meant to be included within the scope of the present invention.

Mono-, di-, or triester variations of these quaternary ammonium compounds have the formula:

$$(R_1)_{4-m}—N^+—[(CH_2)_n—Y—R_3]_mX^-$$

where Y is —O—(O)C—, or —C(O)—O—, or —NH—C(O)—, or —C(O)—NH—; m is 1 to 3; n is 0 to 4; each $R_1$ is a $C_1$-$C_6$ alkyl group, hydroxyalkyl group, hydrocarbyl or substituted hydrocarbyl group, alkoxylated group, benzyl group, or mixtures thereof; each $R_3$ is a $C_{13}$-$C_{21}$ alkyl group, hydroxyalkyl group, hydrocarbyl or substituted hydrocarbyl group, alkoxylated group, benzyl group, or mixtures thereof; and $X^-$ is any softener-compatible anion. Preferably, Y=—O—(O)C—, or —C(O)—O—; m=2; and n=2. Each $R_1$ substituent is preferably a $C_1$-$C_3$, alkyl group, with methyl being most preferred. Preferably, each $R_3$ is $C_{13}$-$C_{17}$ alkyl and/or alkenyl, more preferably $R_3$ is straight chain $C_{15}$-$C_{17}$ alkyl and/or alkenyl, $C_{15}$-$C_{17}$ alkyl, most preferably each $R_3$ is straight-chain $C_{17}$ alkyl. Optionally, the $R_3$ substituent can be derived from vegetable oil sources. Several types of the vegetable oils (e.g., olive, canola, safflower, sunflower, etc.) can used as sources of fatty acids to synthesize the quaternary ammonium compound. Preferably, olive oils, canola oils, high oleic safflower, and/or high erucic rapeseed oils are used to synthesize the quaternary ammonium compound.

As mentioned above, $X^-$ can be any softener-compatible anion. For example, acetate, chloride, bromide, methylsulfate, formate, sulfate, nitrate and the like can be used in the present invention. Preferably $X^-$ is chloride or methyl sulfate.

Specific examples of ester-functional quaternary ammonium compounds having the structures named above and suitable for use in the present invention include the well-known dimethyl sulfate quaternized ester-alkyl ammonium salts having either methyl or ethylhydroxy groups occupying the remainder of the positions on the ammonical nitrogen not substituted with the ester-alkyl functionality. The most applicable of these is the diester ditallow methyl ethylhydroxy ammonium methyl sulfate. Practical production of this molecule will invariably yield a certain fraction of a monoester-monotallow methyl di(ethylhydroxy) ammonium methyl sulfate and a certain fraction of triester tritallow methyl ammonium methyl sulfate, as well as a certain fraction of monoester, diester, and triester tertiary amines not methylated by the dimethyl sulfate during quaternization. A suitable product of this type has been obtained from Stepan Company as "Agent 2450-15". Another common example to which the present invention is applicable is the well known diester ditallow dimethyl ammonium methyl sulfate, which analogously will be accompanied by a certain monoester-monotallow dimethyl ethylhydroxy ammonium methyl sulfate and the tertiary amine analogs of these two molecules not being methylated by the dimethyl sulfate.

Similar quaternary compounds methylated by means of methyl chloride are also common and included within the scope of the above invention.

As mentioned above, typically, half of the fatty acids present in tallow are unsaturated, primarily in the form of oleic acid. Synthetic as well as natural "tallows" fall within the scope of the present invention. It is also known that depending upon the product characteristic requirements, the degree of saturation for such tallows can be tailored from non hydrogenated (soft), to partially hydrogenated (touch), or completely hydrogenated (hard). All of above-described saturation levels of are expressly meant to be included within the scope of the present invention.

It will be understood that substituents $R_1$, $R_2$ and $R_3$ may optionally be substituted with various groups such as alkoxyl, hydroxyl, or can be branched. As mentioned above, preferably each $R_1$ is methyl or hydroxyethyl. Preferably, each $R_2$ is $C_{12}$-$C_{18}$ alkyl and/or alkenyl, most preferably each $R_2$ is straight-chain $C_{16}$-$C_{18}$ alkyl and/or alkenyl, most preferably each $R_2$ is straight-chain $C_{18}$ alkyl or alkenyl. Preferably $R_3$ is $C_{13}$-$C_{17}$ alkyl and/or alkenyl, most preferably $R_3$ is straight chain $C_{15}$-$C_{17}$ alkyl and/or alkenyl. Preferably, $X^-$ is chloride or methyl sulfate. Furthermore the ester-functional quaternary ammonium compounds can optionally contain up to about 10% of the mono(long chain alkyl) derivatives, e.g.:

$$(R_1)_2—N^+—((CH_2)_2OH)((CH_2)_2OC(O)R_3)X^-$$

as minor ingredients. These minor ingredients can act as emulsifiers and are useful in the present invention.

Depending on the softening active ingredient chosen, the desired application level and other factors as may require a particular level of softening active ingredient in the composition, the level of softening active ingredient may vary between about 10% of the composition and about 60% of the composition. Preferably, the softening active ingredient comprises between about 25% and about 50% of the composition. Most preferably, the softening active ingredient comprises between about 30% and about 45% of the composition.

Free Amine

The terms "free amine" and "tertiary amine" are used interchangeably herein. For the purposes of this invention, tertiary amine is defined as the intermediate created during the manufacturing of the quaternary ammonium molecule. Therefore, they would have substantially the same chemical structure as the respective quaternary amine differing only in that they would not be methylated. Alternately, tertiary amines having similar structure to the applicable quaternary amine could be added after the quaternary is formed. It is not critical that the tertiary amines have identical chemical structures, nor mono-alkyl, dialkyl, trialkyl distribution be necessarily the same as the quaternary ammonium end-product. For practical purposes, the most ready means of incorporating the tertiary amine for the present invention is to control the mole ratio of the strong methylating agent during quaternization so that the target ratio of tertiary to quaternary amines remains after the reaction is complete.

The amount of free amine in the composition is measured by the Tertiary to Quaternary Amine Ratio test described in the Test Methods section of this application. The compositions of the present invention comprise a level of tertiary amine such that the tertiary amine to quaternary amine ratio greater than about 0.06, preferably greater than about 0.08, more preferably greater than about 0.1 and less than about 0.2, more preferably less than about 0.18, and more preferably less than about 0.14.

The free amine may be directly added to the composition or, preferably, may be introduced as part of the softening active. Free tertiary amine is an intermediate in the production of quaternary ammonium compounds formed by the esterification of simple amines such as triethanolamine and methyl diethanoloamine. Typically, in industry, in the production of softening quaternary compounds, the quaternization reaction of the ester amines is run to near completion such that the tertiary to quaternary amine ratio is less than about 0.02. The compositions of the present invention may be achieved by stopping the reaction before completion such that a composition of the desired tertiary to quaternary amine value is achieved.

Vehicle

As used herein a "vehicle" is used to dilute the active ingredients of the compositions described herein forming the dispersion of the present invention. A vehicle may dissolve such components (true solution or micellar solution) or such components may be dispersed throughout the vehicle (dispersion or emulsion). The vehicle of a suspension or emulsion is typically the continuous phase thereof. That is, other components of the dispersion or emulsion are dispersed on a molecular level or as discrete particles throughout the vehicle.

For purposes of the present invention, one purpose that the vehicle serves is to dilute the concentration of softening active ingredients so that such ingredients may be efficiently and economically applied to a tissue web. For example, as is discussed below, one way of applying such active ingredients is to spray them onto a roll which then transfers the active ingredients to a moving web of tissue. Typically, only very low levels (e. g. on the order of 2% by weight of the associated tissue) of softening active ingredients are required to effectively improve the tactile sense of softness of a tissue. This means very accurate metering and spraying systems would be required to distribute a "pure" softening active ingredient across the full width of a commercial scale tissue web.

Another purpose of the vehicle is to deliver the active softening composition in a form in which it is less prone to be mobile with regard to the tissue structure. Specifically, it is desired to apply the composition of the present invention so that the active ingredient of the composition resides primarily on the surface of the absorbent tissue web with minimal absorption into the interior of the web. While not wishing to be bound by theory, the Applicants believe that the interaction of the softening composition with preferred vehicles creates a suspended particle which binds more quickly and permanently than if the active ingredient were to be applied without the vehicle. For example, it is believed that suspensions of quaternary softeners in water assume a liquid crystalline form which can be substantively deposited onto the surface of the fibers of the surface of the tissue paper web. Quaternary softeners applied without the aid of the vehicle, e. g. applied in molten form by contrast tend to wick into the internal of the tissue web.

While softening ingredients can be dissolved in a vehicle forming a solution therein, materials that are useful as solvents for suitable softening active ingredients are not commercially desirable for safety and environmental reasons. Therefore, to be suitable for use in the vehicle for purposes of the present invention, a material should be compatible with the softening active ingredients described herein and with the tissue substrate on which the softening compositions of the present invention will be deposited. Further a suitable material should not contain any ingredients that create safety issues (either in the tissue manufacturing process or to users of tissue products using the softening compositions described herein) and not create an unacceptable risk to the environment. Suitable materials for the vehicle of the present invention include hydroxyl functional liquids most preferably water.

Optional Components of the Softening Composition

Plasticizer

The use of quaternary ammonium ingredients as described herein above is most effectively accomplished if the quaternary ammonium ingredient is accompanied by an appropriate plasticizer. The term "plasticizer" as used herein refers to an ingredient capable of reducing the melting point and viscosity at a given temperature of a quaternary ammonium ingredient. The plasticizer can be added during the quaternizing step in the manufacture of the quaternary ammonium ingredient or it can be added subsequent to the quaternization but prior to the application as a softening active ingredient. The plasticizer is characterized by being substantially inert during the chemical synthesis which acts as a viscosity reducer to aid in the synthesis. Preferred plasticizers are non-volatile polyhydroxy compounds. Preferred polyhydroxy compounds include glycerol and polyethylene glycols having a molecular weight of from about 200 to about 2000, with polyethylene glycol having a molecular weight of from about 200 to about 600 being particularly preferred. When such plasticizers are added during manufacture of the quaternary ammonium ingredient, they comprise between about 2% and about 75% percent of the product. Particularly preferred mixtures comprise between about 5% and about 50% plasticizer, and more preferably comprise between about 10% and 25%.

Electrolyte

Any electrolyte meeting the general criteria described above for materials suitable for use in the vehicle of the present invention and which is effective in reducing the viscosity of a dispersion of a softening active ingredient in water is suitable for use in the vehicle of the present invention. In particular, any of the known water-soluble electrolytes meeting the above criteria may be included in the vehicle of the softening composition of the present invention. When present, the electrolyte can be used in amounts up to about 25% by weight of the softening composition, but preferably no more than about 15% by weight of the softening composition. Preferably, the level of electrolyte is between about 0.1% and about 10% by weight of the softening composition based on the anhydrous weight of the electrolyte. Still more preferably, the electrolyte is used at a level of between about 0.3% and about 1.0% by weight of the softening composition. The minimum amount of the electrolyte will be that amount sufficient to provide the desired viscosity. Suitable electrolytes include the halide, nitrate, nitrite, and sulfate salts of alkali or alkaline earth metals, as well as the corresponding ammonium salts. Other useful electrolytes include the alkali and alkaline earth salts of simple organic acids such as sodium formate and sodium acetate, as well as the corresponding ammonium salts. Preferred inorganic electrolytes include the chloride salts of sodium, calcium, and magnesium. Calcium chloride is a particularly preferred inorganic electrolyte for the softening composition of the present invention. A particularly preferred organic acid salt-based electrolyte is sodium formate.

Bilayer Disrupter

A bilayer disrupter may be added to the softening composition of the present invention. Bilayer disrupters useful in the compositions of the present invention are preferably surface active materials. Such materials comprise both hydrophobic and hydrophilic moieties. A preferred hydrophilic moiety is a polyalkoxylated group, preferably a polyethoxylated group. Such preferred bilayer disrupters when used are used at a level of between about 1% and about 20% of the level of the softening active ingredient. Preferably, the bilayer disrupter is present at a level of between about 2% and about 15% of the level of the softening active ingredient, and more preferably at a level of between about 3% and about 10%.

Particularly preferred bilayer disrupters are nonionic surfactants derived from saturated and/or unsaturated primary and/or secondary, amine, amide, amine-oxide fatty alcohol, fatty acid, alkyl phenol, and/or alkyl aryl carboxylic acid compounds, each preferably having from about 6 to about 22, more preferably from about 8 to about 18, carbon atoms in a hydrophobic chain, more preferably an alkyl or alkylene chain, wherein at least one active hydrogen of said compounds is ethoxylated with $\leqq 50$, preferably $\leqq 30$, more preferably from about 3 to about 15, and even more preferably from about 5 to about 12, ethylene oxide moieties to provide an HLB of from about 6 to about 20, preferably from about 8 to about 18, and more preferably from about 10 to about 15. A more complete description of suitable bilayer disrupters for use in compositions containing quaternary softening active is found in U.S. patent application Ser. No. 09/413,578 (Published as WO 00/22231).

High Polymers

High molecular weight polymers (hereinafter "high polymers") which are substantially compatible with the vehicle can also be useful in order to achieve the desired extensional viscosity characteristics for the softening compositions herein. In one embodiment, the high polymer preferably has a substantially linear chain structure, though a linear chain having short ($C_1$-$C_3$) branches or a branched chain having one to three long branches are also suitable for use herein. As used herein, the term "substantially compatible" means that the high polymer appears to dissolve in the vehicle as the continuous phase of the softening composition is being prepared (i.e., the continuous phase appears transparent or translucent to the naked eye). A more complete description of suitable high polymers for use in compositions containing quaternary softening active is found in U.S. patent application Ser. No. 6.547,928.

In order to effectively interact with other high polymer molecules and with the softening active ingredient particles, the high polymer suitable for use herein should have a weight-average molecular weight of at least 500,000. Typically the weight average molecular weight of the polymer ranges from about 500,000 to about 25,000,000, more typically from about 800,000 to about 22,000,000, even more typically from about 1,000,000 to about 20,000,000, and most typically from about 2,000,000 to about 15,000,000. The high molecular weight polymers are preferred in some embodiments of the invention due to the ability to simultaneously interact with several particles of softening active ingredient, thereby increasing extensional viscosity and reducing spray fracture.

Minor Components

The vehicle can also comprise minor ingredients as may be known to the art examples include: mineral acids or buffer systems for pH adjustment (may be required to maintain hydrolytic stability for certain softening active ingredients) and antifoam ingredients (e. g., a silicone emulsion as is available from Dow Corning, Corp. of Midland, Mich. as Dow Corning 2310) as a processing aid to reduce foaming when the softening composition of the present invention is applied to a web of tissue.

It may also be desirable to provide means to control the activity of undesirable microorganisms in the softening composition of the present invention. It is known that organisms, such as bacteria, molds, yeasts, and the like, can cause degradation of the composition on storage. Undesirable organisms can also potentially transfer to users of tissue paper products that are softened with a composition according to the present invention that is contaminated by such organisms. These undesirable organisms can be controlled by adding an effective amount of a biocidal material to the softening composition. Proxel GXL, as is available from Avecia, Inc. of Wilmington, Del., has been found to be an effective biocide in the composition of the present invention when used at a level of about 0.1%. Alternatively, the pH of the composition can be made more acid to create a more hostile environment for undesirable microorganisms. Means such as those described above can be used to adjust the pH to be in a range of between about 2.5 to 4.0, preferably between about 2.5 and 3.5, more preferably between about 2.5 and about 3.0 so as to create such a hostile environment.

Stabilizers may also be used to improve the uniformity and shelf life of the dispersion. For example, an ethoxylated polyester, HOE S 4060, available from Clariant Corporation of Charlotte, N.C. may be included for this purpose.

Forming the Softening Composition

As noted above, the softening composition of the present invention is a dispersion of a softening active ingredient in a vehicle. As noted above, the preferred primary component of the vehicle is water. Depending on the softening active ingredient chosen, the desired application level and other factors as may require a particular level of softening active ingredient in the composition, the level of softening active ingredient may vary between about 10% of the composition and about 50% of the composition in the vehicle chosen. The composition also consists of free amine, either directly added or from incomplete quaternization of amine as described above, such that the tertiary amine to quaternary amine ratio is greater than about 0.06 and less than about 0.20.

Optionally, nonionic surfactant, high polymer, or plasticizer may be added at desired levels. In addition, the composition may optionally comprise an alkali or alkaline earth salt of a simple organic acid electrolyte and may comprise minor ingredients to adjust pH, to control foam, or to aid in stability of the dispersion.

A particularly preferred softening composition of the present invention is prepared as follows. The materials comprising this composition are more specifically defined in Table 1 which follows this description. Amounts used in each step are sufficient to result in the finished composition detailed in that table. The appropriate quantity of water is heated (extra water may be added to compensate for evaporation loss) to about 200° F. (93° C.). Sulfuric acid (38% solution) and antifoam ingredient are added. Concurrently, the blend of softening active ingredient and plasticizer is brought a temperature of about 190° F. (88° C.). The melted mixture of softening active ingredient and plasticizer is then slowly added to the heated acidic aqueous phase with mixing to evenly distribute the disperse phase throughout the vehicle. (The water solubility of the polyethylene glycol probably carries it into the continuous phase, but this is not essential to the invention and plasticizers which are more hydrophobic and thus remain associated with the alkyl chains of the quaternary ammonium compound are also allowed within the scope of the present invention.) Once the softening active ingredient is thoroughly dispersed and the dispersion temperature is 160-170° F. (71-77° C.), part of the sodium formate is added (as a 5% solution) intermittently with mixing to provide an initial viscosity reduction. The stabilizer is then slowly added to the mixture with continued agitation. After the dispersion cools to 120-140° F. (49-60° C.), part of the sodium formate (as a 25% solution) is then added for further viscosity reduction. The remainder of the sodium formate (as a 50% solution) is added after the dispersion cools to less than 120° F. (49° C.). Lastly, nonionic surfactant is added with continued mixing. For purposes of determining active ingredients, quat active is equal to cationic active.

TABLE 1

| Component | Concentration |
|---|---|
| Water | QS to 100% |
| Electrolyte[1] | 2.3% |
| Antifoam[2] | 0.25% |
| Bilayer Disrupter[3] | 0.35% |
| Sulfuric Acid[4] | 0.57% |
| Plasticizer[5] | 19.4% |
| Stabilizer[6] | 1.8% |
| Softening Active Ingredient[5] | 42.4% |

[1]0.55% from 5% aqueous sodium formate solution, 0.55% from 25% aqueous sodium formate solution and 1.2% from 50% aqueous sodium formate solution.
[2]Silicone Emulsion (10% active)-Dow Corning 2310 ®, marketed by Dow Corning Corp., Midland, MI
[3]Suitable nonionic surfactants are available from Shell Chemical of Houston, TX under the trade name NEODOL 91-8.
[4]Available as a 38% solution from J. T. Baker Chemical Company of Phillipsburg, NJ
[5]Plasticizer, softening active ingredient, and minor inert ingredients are obtained pre-blended from Stepan Chemical Company of Northfield, Il as Agent 2450-15.
[6]Stabilizer is Texcare 4060, from Clariant Corp., Charlotte, NC The resulting chemical softening composition is a milky, low viscosity dispersion suitable for application to cellulosic structures as described below for providing desirable tactile softness to such structures. It displays a shear-thinning non-Newtonian viscosity. The tertiary amine to quaternary amine ratio is 0.13.

Tissue Paper

The present invention is applicable to tissue paper in general, including but not limited to: conventionally felt-pressed tissue paper; pattern densified tissue paper; and high-bulk, uncompacted tissue paper. The tissue paper may be of a homogenous or multilayered construction; and tissue paper products made therefrom may be of a single-ply or multi-ply construction. The tissue paper preferably has a basis weight of between about 10 g/m$^2$ and about 80 g/m$^2$, and density of about 0.60 g/cc or less. Preferably, the basis weight will be below about 35 g/m$^2$ or less; and the density will be about 0.30 g/cc or less. Most preferably, the density will be between about 0.04 g/cc and about 0.20 g/cc.

Conventionally pressed tissue paper and methods for making such paper are known in the art. See commonly assigned U.S. patent application Ser. No. 09/997,950 filed Nov. 30, 2001. One preferred tissue paper is pattern densified tissue paper which is characterized by having a relatively high-bulk field of relatively low fiber density and an array of densified zones of relatively high fiber density. The high-bulk field is alternatively characterized as a field of pillow regions. The densified zones are alternatively referred to as knuckle regions. The densified zones may be discretely spaced within the high-bulk field or may be interconnected, either fully or partially, within the high-bulk field. Preferred processes for making pattern densified tissue webs are disclosed in U.S. Pat. No. 3,301,746, issued to Sanford and Sisson on Jan. 31, 1967, U.S. Pat. No. 3,974,025, issued to Ayers on Aug. 10, 1976, U.S. Pat. No. 4,191,609, issued to on Mar. 4, 1980, and U.S. Pat. No. 4,637,859, issued to on Jan. 20, 1987; U.S. Pat. No. 3,301,746, issued to Sanford and Sisson on Jan. 31, 1967, U.S. Pat. No. 3,821,068, issued to Salvucci, Jr. et al. on May 21, 1974, U.S. Pat. No. 3,974,025, issued to Ayers on Aug. 10, 1976, U.S. Pat. No. 3,573,164, issued to Friedberg, et al. on Mar. 30, 1971, U.S. Pat. No. 3,473,576, issued to Amneus on Oct. 21, 1969, U.S. Pat. No. 4,239,065, issued to Trokhan on Dec. 16, 1980, and U.S. Pat. No. 4,528,239, issued to Trokhan on Jul. 9, 1985.

Uncompacted, non pattern-densified tissue paper structures are also contemplated within the scope of the present invention and are described in U.S. Pat. No. 3,812,000 issued to Joseph L. Salvucci, Jr. and Peter N. Yiannos on May 21, 1974, and U.S. Pat. No. 4,208,459, issued to Henry E. Becker, Albert L. McConnell, and Richard Schutte on Jun. 17, 1980.

The softening composition of the present invention can also be applied to uncreped tissue paper. Uncreped tissue paper, a term as used herein, refers to tissue paper which is non-compressively dried, most preferably by through air drying. Resultant through air dried webs are pattern densified such that zones of relatively high density are dispersed within a high bulk field, including pattern densified tissue wherein zones of relatively high density are continuous and the high bulk field is discrete. The techniques to produce uncreped tissue in this manner are taught in the prior art. For example, Wendt, et. al. in European Patent Application 0 677 612A2, published Oct. 18, 1995; Hyland, et. al. in European Patent Application 0 617 164 A1, published Sep. 28, 1994; and Farrington, et. al. in U.S. Pat. No. 5,656,132 published Aug. 12, 1997.

Furnish

Papermaking Fibers

The papermaking fibers utilized for the present invention will normally include fibers derived from wood pulp. Other cellulosic fibrous pulp fibers, such as cotton linters, bagasse, etc., can be utilized and are intended to be within the scope of this invention. Synthetic fibers, such as rayon, polyethylene and polypropylene fibers, may also be utilized in combination with natural cellulosic fibers. One exemplary polyethylene fiber which may be utilized is Pulpex®, available from Hercules, Inc. (Wilmington, Del.).

Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, are preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. Also applicable to the present invention are fibers derived from recycled paper, which may contain any or all of the above categories as well as other non-fibrous materials such as fillers and adhesives used to facilitate the original papermaking.

Optional Chemical Additives

Other materials can be added to the aqueous papermaking furnish or the embryonic web to impart other desirable characteristics to the product or improve the papermaking process so long as they are compatible with the chemistry of the softening composition and do not significantly and adversely affect the softness or strength character of the present invention. The following materials are expressly included, but their inclusion is not offered to be all-inclusive. Other materials can be included as well so long as they do not interfere or counteract the advantages of the present invention.

It is common to add a cationic charge biasing species to the papermaking process to control the zeta potential of the aqueous papermaking furnish as it is delivered to the papermaking process. These materials are used because most of the solids in nature have negative surface charges, including the surfaces of cellulosic fibers and fines and most inorganic fillers. One traditionally used cationic charge biasing species is alum. More recently in the art, charge biasing is done by use of relatively low molecular weight cationic synthetic polymers preferably having a molecular weight of no more than about 500,000 and more preferably no more than about 200,000, or even about 100,000. The charge densities of such low molecular weight cationic synthetic polymers are relatively high. These charge densities range from about 4 to about 8 equivalents of cationic nitrogen per kilogram of polymer. An exemplary material is Cypro 514®, a product of Cytec, Inc. of Stamford, Conn. The use of such materials is expressly allowed within the practice of the present invention.

The use of high surface area, high anionic charge microparticles for the purposes of improving formation, drainage, strength, and retention is taught in the art. See, for example, U.S. Pat. No. 5,221,435, issued to Smith on Jun. 22, 1993, the disclosure of which is incorporated herein by reference.

If permanent wet strength is desired, cationic wet strength resins can be added to the papermaking furnish or to the embryonic web. Suitable types of such resins are described in U.S. Pat. No. 3,700,623, issued on Oct. 24, 1972, and U.S. Pat. No. 3,772,076, issued on Nov. 13, 1973, both to Keim.

Many paper products must have limited strength when wet because of the need to dispose of them through toilets into septic or sewer systems. If wet strength is imparted to these products, fugitive wet strength, characterized by a decay of part or all of the initial strength upon standing in presence of water, is preferred. If fugitive wet strength is desired, the binder materials can be chosen from the group consisting of dialdehyde starch or other resins with aldehyde functionality such as Co-Bond 1000® offered by National Starch and Chemical Company of Scarborough, Me.; Parez 750® offered by Cytec of Stamford, Conn.; and the resin described in U.S. Pat. No. 4,981,557, issued on Jan. 1, 1991, to Bjorkquist, and other such resins having the decay properties described above as may be known to the art.

If enhanced absorbency is needed, surfactants may be used to treat the tissue paper webs of the present invention. The level of surfactant, if used, is preferably from about 0.01% to about 2.0% by weight, based on the dry fiber weight of the tissue web. The surfactants preferably have alkyl chains with eight or more carbon atoms. Exemplary anionic surfactants include linear alkyl sulfonates and alkylbenzene sulfonates. Exemplary nonionic surfactants include alkylglycosides including alkylglycoside esters such as Crodesta SL-40® which is available from Croda, Inc. (New York, N.Y.); alkylglycoside ethers as described in U.S. Pat. No. 4,011,389, issued to Langdon, et al. on Mar. 8, 1977; and alkylpolyethoxylated esters such as Pegosperse 200 ML available from Glyco Chemicals, Inc. (Greenwich, Conn.) and IGEPAL RC-520® available from Rhone Poulenc Corporation (Cranbury, N.J.). Alternatively, cationic softener active ingredients with a high degree of unsaturated (mono and/or poly) and/or branched chain alkyl groups can greatly enhance absorbency.

While the preferred embodiment of the present invention discloses a certain softening agent composition deposited on the tissue web surface, the invention also expressly includes variations in which the chemical softening agents are added as a part of the papermaking process. For example, chemical softening agents may be included by wet end addition. In addition, other chemical softening agents, in a form not within the scope of the present invention may be used. Preferred chemical softening agents comprise quaternary ammonium compounds including, but not limited to, the well-known dialkyldimethylammonium salts (e.g., ditallowdimethylammonium chloride, ditallowdimethylammonium methyl sulfate, di(hydrogenated tallow)dimethyl ammonium chloride, etc.). Particularly preferred variants of these softening agents include mono or diester variations of the before mentioned dialkyldimethylammonium salts and ester quaternaries made from the reaction of fatty acid and either methyl diethanol amine and/or triethanol amine, followed by quaternization with methyl chloride or dimethyl sulfate.

Another class of papermaking-added chemical softening agents comprise the well-known organo-reactive polydimethyl siloxane ingredients, including the most preferred amino functional polydimethyl siloxane.

Filler materials may also be incorporated into the tissue papers of the present invention. U.S. Pat. No. 5,611,890, issued to Vinson et al. on Mar. 18, 1997, and, incorporated herein by reference discloses filled tissue paper products that are acceptable as substrates for the present invention.

The above listings of optional chemical additives is intended to be merely exemplary in nature, and are not meant to limit the scope of the invention.

Application Method

The amount of softening active applied to the tissue paper is preferably, between about 0.1% and about 10% based on the total weight of the softening composition compared to the total weight of the resulting tissue paper. The resulting tissue paper preferably has a basis weight of from about 10 to about 80 g/m$^2$ and a fiber density of less than about 0.6 g/cc. The levels of softener additives used to soften the tissue paper are low enough that the tissue paper retains high wettability.

In a preferred embodiment, the composition of the present invention is applied to an overdried tissue web shortly after it is separated from a drying means and before it is wound onto a parent roll. Alternatively, the composition of the present invention may be applied to a semi-dry tissue web, for example while the web is on the Fourdrinier cloth, on a drying felt or fabric, or while the web is in contact with the Yankee dryer or other alternative drying means. Finally, the composition can also be applied to a dry tissue web in moisture equilibrium with its environment as the web is unwound from a parent roll as for example during an off-line converting operation.

In one preferred embodiment, the softening composition of the current invention may be applied after the tissue web has been dried and creped, and, more preferably, while the web is still at an elevated temperature. Preferably, the softening composition is applied to the dried and creped tissue web before the web is wound onto the parent roll. Thus, in a preferred embodiment of the present invention the softening composition is applied to a hot, overdried tissue web after the web has been creped and after the web has passed through the calender rolls which control the caliper.

The softening composition described above is preferably applied to the web in a macroscopically uniform fashion so that substantially the entire sheet benefits from the effect of the softening composition. Following application to the hot web, at least a portion of the volatile components of the vehicle preferably evaporates leaving preferably a thin film containing any remaining unevaporated portion of the volatile components of the vehicle, the softening active ingredient, and other nonvolatile components of the softening composition. By "thin film" is meant any thin coating, haze or mist on the web. This thin film can be microscopically continuous or be comprised of discrete elements. If the thin film is comprised of discrete elements, the elements can be of uniform size or varying in size; further they may be arranged in a regular pattern or in an irregular pattern, but macroscopically the thin film is uniform. Preferably the thin film is composed of discrete elements.

The softening composition can be added to either side of the tissue web singularly, or to both sides.

A preferred method of macroscopically uniformly applying the softening composition to the web is spraying. Spraying has been found to be economical, and can be accurately controlled with respect to quantity and distribution of the softening composition, so it is more preferred. The dispersed softening composition is applied onto the dried, creped tissue web after the Yankee dryer and before the parent roll. A particularly convenient means of accomplishing this application is to apply the softening composition to the web after the calender rolls and before the parent roll. A particularly preferred application position is between the calender rolls and any spreading roll that may be positioned between the calender rolls and the parent roll. Such position is particularly preferred because the web is controlled by rolls at each end of the span where the composition is applied and there is still some web path length before the web is wound onto the parent roll for volatilization of the vehicle.

FIG. 1 illustrates a preferred method of applying the softening composition to the tissue web. Referring to FIG. 1, a wet tissue web 1 is on carrier fabric 14 past turning roll 2 and transferred to Yankee dryer 5 by the action of pressure roll 3 while carrier fabric 14 travels past turning roll 16. The web is adhesively secured to the cylindrical surface of Yankee dryer 5 by adhesive applied by spray applicator 4. Drying is completed by steam-heated Yankee dryer 5 and by hot air which is heated and circulated through drying hood 6 by means not shown. The web is then dry creped from the Yankee dryer 5 by doctor blade 7, after which it is designated creped paper sheet 15. Paper sheet 15 then passes through calender rolls 10 and 11. The softening composition is then applied to sheet 15 by spray applicator 8 in the span between calender rolls 10, 11 and spreading roll 9. The treated sheet 15 then travels over a circumferential portion of reel 12 and is wound onto parent roll 13 after a portion of the vehicle has evaporated as the web passes through the span between spreading roll 9 and reel 12.

Suitably, the softening composition is disposed at a level of between about 0.1% and about 8% of the weight of the paper sheet 15, preferably between about 0.1% and about 5%, more preferably between about 0.1% and about 3%.

While not wishing to be bound by theory or to otherwise limit the present invention, the following description of typical process conditions encountered during the papermaking operation and their impact on the process described in this invention is provided. The Yankee dryer raises the temperature of the tissue sheet and removes the moisture. The steam pressure in the Yankee is on the order of 110 PSI (750 kPa). This pressure is sufficient to increase the temperature of the cylinder to about 170° C. The temperature of the paper on the cylinder is raised as the water in the sheet is removed. The temperature of the sheet as it leaves the doctor blade can be in excess of 120° C. The sheet travels through space to the calender and the reel and loses some of this heat. The temperature of the paper wound in the reel is measured to be on the order of 60° C. Eventually the sheet of paper cools to room temperature. This can take anywhere from hours to days depending on the size of the paper roll. As the paper cools it also absorbs moisture from the atmosphere.

Since the softening composition of the present invention is applied to the paper while it is overdried, the water added to the paper with the softening composition by this method (i.e. residual water that does not evaporate in the span between spreading roll 9 and reel 12) is not sufficient to cause the paper to lose a significant amount of its strength and thickness. Thus, no further drying is required.

EXAMPLES

Example 1

Three dispersions illustrating the effect of tertiary to quaternary amine ratio on their performance are described in this example. The materials comprising these compositions are more specifically defined in Table 2 which follows this description. Amounts used in each step are sufficient to result in the finished composition detailed in that table. The appropriate quantity of water is heated (extra water may be added to compensate for evaporation loss) to about 200° F. (93° C.). Sulfuric acid (38% solution) and antifoam ingredient are added. Concurrently, the blend of softening active ingredient and plasticizer is melted by heating it to a temperature of about 190° F. (88° C.). The melted mixture of softening active ingredient and plasticizer is then slowly added to the heated acidic aqueous phase with mixing to evenly distribute the disperse phase throughout the vehicle.

Once the softening active ingredient is thoroughly dispersed and the dispersion temperature is 160-170° F. (71-77° C.), part of the sodium formate is added (as a 5% solution) intermittently with mixing to provide an initial viscosity reduction. The stabilizer is then slowly added to the mixture with continued agitation. After the dispersion cools to 120-140° F. (49-60° C.), part of the sodium formate (as a 25% solution) is then added for further viscosity reduction. The remainder of the sodium formate (as a 50% solution) isadded after the dispersion cools to less than 120° F. (49° C.). Lastly, nonionic surfactant is added with continued mixing. For purposes of determining active ingredients, quat active is equal to cationic active.

TABLE 2

| Component | 1 | 2 | 3 |
|---|---|---|---|
| Water | QS to 100% | QS to 100% | QS to 100% |
| Electrolyte[1] | 2.51% | 2.54% | 2.54% |
| Antifoam[2] | 0.23% | 0.24% | 0.24% |
| Bilayer Disrupter[3] | 0.30% | 0.29% | 0.28% |
| Sulfuric Acid[4] | 0.77% | 0.79% | 0.79% |
| Plasticizer[5] | 17.4% | 17.1% | 17.0% |
| Stabilizer[6] | 1.71% | 1.76% | 1.86% |
| Softening Active Ingredient[5] | 40.6% | 39.8% | 39.6% |
| (Tertiary to Quaternary Amine Ratio) | (0.189) | (0.026) | (0.119) |
| Resulting dispersion viscosity (cp @ 8/s shear rate) | 2,400 | 12,000 | 630 |

[1]0.55% from 5% aqueous sodium formate solution, 0.55% from 25% aqueous sodium formate solution and 1.2% from 50% aqueous sodium formate solution.
[2]Silicon Emulsion (10% active)-Dow Corning 2310 ®, marketed by Dow Corning Corp., Midland, MI
[3]Suitable nonionic surfactants are available from Shell Chemical of Houston, TX under the trade name NEODOL 91-8.
[4]Available as a 38% solution from J. T. Baker Chemical Company of Phillipsburg, NJ (The acid % in the tables reflects as is at 38%)
[5]Plasticizer, softening active ingredient, and minor inert ingredients obtained preblended from Goldschmidt Chemical Corporation of Dublin, OH as DXP 5497-39.
[6]Stabilizer is Texcare 4060, from Clariant Corp., Charlotte, NC The resulting chemical softening composition are milky, low viscosity, dispersions suitable for application to cellulosic structures as described below for providing desirable tactile softness to such structures. They display a shear-thinning non-Newtonian viscosity. The dispersion having the tertiary to quaternary amine ratio of about 0.12 is preferred over those having a higher or lower ratio.

Example 2

This Example illustrates preparation of tissue paper exhibiting one embodiment of the present invention. This example demonstrates the production of homogeneous tissue paper webs that are provided with a preferred embodiment of the softening composition of the present invention made as described above. The composition is applied to one side of the web and the webs are combined into a two-ply bath tissue product.

A pilot scale Fourdrinier papermaking machine is used in the practice of the present invention.

An aqueous slurry of NSK of about 3% consistency is made up using a conventional repulper and is passed through a stock pipe toward the headbox of the Fourdrinier.

In order to impart temporary wet strength to the finished product, a 1% dispersion of Parez 750® is prepared and is added to the NSK stock pipe at a rate sufficient to deliver 0.3% Parez 750® based on the dry weight of the NSK fibers. The absorption of the temporary wet strength resin is enhanced by passing the treated slurry through an in-line mixer.

An aqueous slurry of eucalyptus fibers of about 3% by weight is made up using a conventional repulper. The stock pipe carrying eucalyptus fibers is treated with a cationic starch, RediBOND 5320®, which is delivered as a 2% dispersion in water and at a rate of 0.15% based on the dry weight of starch and the finished dry weight of the resultant creped tissue product. Absorption of the cationic starch is improved by passing the resultant mixture through an in line mixer.

The stream of NSK fibers and eucalyptus fibers are then combined in a single stock pipe prior to the inlet of the fan pump. The combined NSK fibers and eucalyptus fibers are then diluted with white water at the inlet of a fan pump to a consistency of about 0.2% based on the total weight of the NSK fibers and eucalyptus fibers.

The homogeneous slurry of NSK fibers and eucalyptus fibers are directed into a multi-channeled headbox suitably equipped to maintain the homogeneous stream until discharged onto a traveling Fourdrinier wire. The homogeneous slurry is discharged onto the traveling Fourdrinier wire and is dewatered through the Fourdrinier wire and is assisted by a deflector and vacuum boxes.

The embryonic wet web is transferred from the Fourdrinier wire, at a fiber consistency of about 15% at the point of transfer, to a patterned drying fabric. The drying fabric is designed to yield a pattern densified tissue with discontinuous low-density deflected areas arranged within a continuous network of high density (knuckle) areas. This drying fabric is formed by casting an impervious resin surface onto a fiber mesh supporting fabric. The supporting fabric is a 45×52 filament, dual layer mesh. The thickness of the resin cast is about 10 mil above the supporting fabric. The knuckle area is about 40% and the open cells remain at a frequency of about 562 per square inch.

Further dewatering is accomplished by vacuum assisted drainage until the web has a fiber consistency of about 28%.

While remaining in contact with the patterned forming fabric, the patterned web is pre-dried by air blow-through predryers to a fiber consistency of about 62% by weight.

The semi-dry web is then transferred to the Yankee dryer and adhered to the surface of the Yankee dryer with a sprayed creping adhesive comprising a 0.125% aqueous solution of polyvinyl alcohol. The creping adhesive is delivered to the Yankee surface at a rate of 0.1% adhesive solids based on the dry weight of the web.

The fiber consistency is increased to about 96% before the web is dry creped from the Yankee with a doctor blade.

The doctor blade has a bevel angle of about 25 degrees and is positioned with respect to the Yankee dryer to provide an impact angle of about 81 degrees. The Yankee dryer is operated at a temperature of about 350° F. (177° C.) and a speed of about 800 fpm (feet per minute) (about 244 meters per minute).

The web is then passed between two calender rolls. The two calender rolls are biased together at roll weight and operated at surface speeds of 656 fpm (about 200 meters per minute) which produces a percent crepe of about 18%.

At a location after the calender rolls, the web is sprayed with a chemical softening composition, further described below, using the aforementioned UFD nozzle. The composition is sprayed on the surface opposite to that contacted by the downstream spreading roll.

Materials used in the preparation of the chemical softening mixture are:

1. Soft tallow TEA Diester DMS quaternary ammonium compound premixed with polyethylene glycol 400. The premix is 65-75% quaternary ammonium compound and 25-35% PEG 400 and minor inert ingredients, (available from Stepan Company of Northfield, Ill. as Agent 2450-15).
2. Neodol 91-8, an ethoxylated fatty alcohol from Shell chemical of Houston, Tex.

3. Sodium Formate crystal.
4. Polydimethylsiloxane 10 percent dispersion in water (DC2310) from Dow Corning of Midland, Mich.
5. Sulfuric acid from J. T. Baker Company of Phillipsburg, N.J.
6. Brightener is Tinopal CBS-X, obtainable from CIBA-GEIGY of Greensboro, N.C.
7. Stabilizer is Texcare 4060, from Clariant Corp., Charlotte, N.C.

These materials are prepared as follows to form the softening composition of the present invention.

The chemical softening composition (Composition 1) is prepared as follows: The appropriate quantity of water is heated (extra water may be added to compensate for evaporation loss) to about 200° F. (93° C.). Sulfuric acid (38% solution) and antifoam ingredient are added. Concurrently, the blend of softening active ingredient and plasticizer is melted by heating it to a temperature of about 190° F. (88° C.). The melted mixture of softening active ingredient and plasticizer is then slowly added to the heated acidic aqueous phase with mixing to evenly distribute the disperse phase throughout the vehicle.

Once the softening active ingredient is thoroughly dispersed and the dispersion temperature is 160-170° F. (71-77° C.), part of the sodium formate is added (as a 5% solution) intermittently with mixing to provide an initial viscosity reduction. The stabilizer is then slowly added to the mixture with continued agitation. After the dispersion cools to 120-140° F. (49-60° C.), part of the sodium formate (as a 25% solution) is then added for further viscosity reduction. The remainder of the sodium formate (as a 50% solution) is added after the dispersion cools to less than 120° F. (49° C.). Lastly, nonionic surfactant is added with continued mixing. For purposes of determining active ingredients, quat active is equal to cationic active.

| Component | Concentration |
|---|---|
| Water | QS to 100% |
| Electrolyte[1] | 2.3% |
| Antifoam[2] | 0.25% |
| Bilayer Disrupter[3] | 0.35% |
| Sulfuric Acid[4] | 0.57% |
| Plasticizer[5] | 19.4% |
| Stabilizer[6] | 1.8% |
| Softening Active Ingredient[5] | 42.4% |

[1]0.55% from 5% aqueous sodium formate solution, 0.55% from 25% aqueous sodium formate solution and 1.2% from 50% aqueous sodium formate solution.
[2]Silicone Emulsion (10% active)-Dow Corning 2310 ®, marketed by Dow Corning Corp., Midland, MI
[3]Suitable nonionic surfactants are available from Shell Chemical of Houston, TX under the trade name NEODOL 91-8.
[4]Available as a 38% solution from J. T. Baker Chemical Company of Phillipsburg, NJ
[5]Plasticizer, softening active ingredient and minor inert ingredients obtained preblended from Stepan Chemical Company of Northfield, Il as Agent 2450-15.
[6]Stabilizer is Texcare 4060, from Clariant Corp., Charlotte, NC After cooling, the composition has a viscosity of about 200 cp as measured at 25° C. and at a shear rate of 100 $sec^{-1}$. The resulting chemical softening composition is a milky, low viscosity dispersion suitable for application to cellulosic structures as described below for providing desirable tactile softness to such structures. It displays a shear-thinning non-Newtonian viscosity. The tertiary amine to quaternary amine ratio is 0.13.

The chemical softening composition is sprayed onto the web downstream of the calender rolls. The resulting tissue paper has a basis weight of about 18 lb per 3000 $ft^2$.

The web is converted into a creped patterned densified tissue paper product. The resulting treated tissue paper has an improved tactile sense of softness relative to an untreated control.

Test Methods

1. Viscosity Measurements on a Rheometrics Dynamic Stress Rheometer 25 mm diameter Parallel plate geometry, 0.50 mm gap, ~400 g/cm2 tool inertia, temperature at 25° C., Initial stress 10 dynes/cm2, Final Stress 1000 dynes/cm2, Stress increment 50 dynes/cm2, maximum time per data point 10 seconds 2. Tertiary to Quaternary Amine Ratio The tertiary amine to quaternary amine ratio is the ratio of the values determined by the methods in a. and b., below.

$$\text{Tertiary amine to Quaternary amine ratio} = \frac{mEq \text{ tertiary amine/g sample}}{mEq \text{ quaternary amine/g sample}}$$

a. Tertiary amine level is determined by a potentiometric titration with hydrochloric acid in isopropanol. Results are reported as mEq amine/g sample. The following method is appropriate for determining the quantity of the tertiary ammonium compounds in the softening composition of the present invention. A standard hydrochloric acid/isopropanol titrant is used to titrate the free tertiary amine.

Preparation of Standard Solutions

The following methods are applicable for the preparation of the standard solutions used in this titration method.

Preparation of the HCl/IPA Titrant.

To a 1 liter volumetric flask:

A) Measure 900 mLs of isopropanol.

B) Slowly add 100 mLs of 1N hydrochloric acid and mix.

C) Standardize with THAM.

Method

1. On an analytical balance, accurately weigh 10.0 g±0.5 grams of softening composition sample into a tared 150 mL beaker.
2. Dissolve in 100 mL of isopropanol while stirring. Add 0.5 mL water.
3. Titrate with standardized 0.1N HCl tittant using a recording potentiometric titrator. Titrate until the equivalence point is reached.
4. Calculate the amount of tertiary amine in the softening composition using the equation:

$$mEq \text{ Tertiary Amine/g} = \frac{(\text{mLs of HCl}) \times (\text{Normality of HCl})}{\text{Sample weight (grams)}}$$

b. Quaternary amines level as defined by this method is equivalent to cationic active level and is determined by colorimetric titration with an anionic surfactant using a mixed indicator of cationic- and anionic-complexing dyes in a water-dichloromethane system. It is recognized that at higher tertiary amine level the difference between the cationic active level, "quaternary amine level" for this ratio purpose, and the actual level of quaternary amines can become significant. However, for consistency with nomenclature of the trade, the quaternary amine level used in the ratio of the present invention shall be that defined by this test method. The following method is appropriate for determining the quantity of the preferred quaternary ammonium compounds in the softening composition of the present invention. A standard anionic surfactant (sodium dodecylsulfate—SDS) solution is used to titrate the quaternary softening active using a dimidium bromide indicator.

Preparation of Standard Solutions

The following methods are applicable for the preparation of the standard solutions used in this titration method.

Preparation of Dimidium Bromide Indicator

To a 1 liter volumetric flask:

A) Add 500 milliliters of distilled water.

B) Add 40 ml. of dimidium bromide-disulphine blue indicator stock solution, available from Gallard-Schlesinger Industries, Inc. of Carle Place, N.Y.

C) Add 40 ml. of 5N $H_2SO_4$

D) Fill flask to the mark with distilled water and mix.

Preparation of the SDS Solution.

To a 1 liter volumetric flask:

A) Weigh 1.1535 grams of Sodium Dodecylsulfate (SDS) available from Aldrich Chemical Co. of Milwaukee, Wis. (ultra pure).

B) Fill flask to mark with distilled water and mix to form a 0.004N solution.

Method

1. On an analytical balance, weigh approximately 0.275 grams of room temperature softening composition into a titration cylinder. Record the sample weight to the nearest 0.1 mg.
2. Using a graduated cylinder, add 30 milliliters of dichloromethane (DCM) and 30 milliliters of the dimidium bromide indicator solution. Place on magnetic stirrer, add stir bar and stir vigorously. The quaternary softening active will complex with the indicator forming a blue colored compound in the DCM layer.
3. Using a 25 or 50 ml. burette, titrate the sample with the 0.004N SDS solution. This is done by adding an aliquot of titrant and rapidly stirring for 30 seconds. Turn off the stir plate, allow the layers to separate, and check the intensity of the blue color. If the color is dark blue add about 0.3 milliliters of titrant, rapidly stir for 30 seconds and turn off stirrer. Again check the intensity of the blue color. Repeat if necessary with another 0.3 milliliters. When the blue color starts to become very faint, add the titrant dropwise between stirrings. The endpoint is the first sign of a slight pink color in the methylene chloride layer.
4. Record the volume of titrant used to the nearest 0.05 ml.
5. Calculate the amount of quaternary softening active in the product using the equation:

$$mEq \text{ Quaternary Amine/g sample} = \frac{(\text{mLs of } SDS \text{ recorded}) \times (\text{Normality of titrant})}{\text{Sample weight (grams)}}$$

What is claimed is:

1. A composition for softening an absorbent tissue comprising:

a) from about 10% to about 60% by weight of a quaternary ammonium softening active ingredient;

b) free amine compounds at a level such that the softening composition has a tertiary to quaternary amine ratio of greater than about 0.06 and less than about 0.2; wherein said softening active ingredient is selected from the group consisting of quaternary compounds; mono-, di-, and tri-ester quaternary ammonium compounds, and mixtures thereof and;

wherein said softening active ingredient is a mono-, di-, or tri-ester quaternary ammonium compound having the formula:

$$(R_1)_{4-m}—N^+—[(CH_2)_n—Y—R_3]_mX^-$$

wherein Y is —O—(O)C—, or —C(O)—O—, or —NH—C(O)—, or —C(O)—NH—;

m is 1 to 3; n is 0 to 4; each $R_1$ is a $C_1$-$C_6$ alkyl or alkenyl group, hydroxyalkyl group, hydrocarbyl or substituted hydrocarbyl group, alkoxylated group, benzyl group, or mixtures thereof;

each $R_3$ is a $C_{13}$-$C_{21}$ alkyl or alkenyl group, hydroxyalkyl group, hydrocarbyl or substituted hydrocarbyl group, alkoxylated group, benzyl group, or mixtures thereof; and $X^-$ is any softener-compatible anion; and wherein said free amine compounds has substantially the same chemical structure as a respective quaternary amine, except that said free amine compounds are not methylated;

c) an aqueous vehicle in which said softening active ingredient is dispersed;

d) from about 0.01% to about 5% by weight of a high polymer; wherein the high polymer has a weight-average molecular weight of from about 2,000,000 to about 25,000,000; and e) from about 1% to about 20% by weight of a bilayer disrupter; wherein the bilayer disrupter is a nonionic surfactant derived from saturated and/or unsaturated primary and/or secondary, amine, amide, amine-oxide fatty alcohol, fatty acid, alkyl phenol, and/or alkyl aryl carboxylic acid compounds, and have from about 6 to about 22 carbon atoms in a hydrophobic chain.

2. The composition of claim 1 wherein the softening composition has a tertiary to quaternary amine ratio of greater than about 0.08 and less than about 0.18.

3. The composition of claim 1 wherein the softening active ingredient comprises at least about 10% by weight of the composition.

4. The composition of claim 3 wherein the softening active ingredient comprises no more than 60% by weight of the composition.

5. The composition of claim 1 further comprising from about 2% to about 75% by weight of a plasticizer.

6. The composition of claim 1 further comprising up to about 25% by weight of an electrolyte.

7. The composition of claim 1 wherein m is 3, n is 2, $R_1$ is methyl, $R_3$ is $C_{15}$-$C_{17}$ alkyl or alkenyl, and Y is —O—(O)C—, or —C(O)—O—.

8. The composition of claim 7 wherein $X^-$ is selected from the group consisting of chloride or methyl sulfate.

* * * * *